US006071563A

United States Patent [19]

Kozlowski et al.

[11] Patent Number: 6,071,563

[45] Date of Patent: Jun. 6, 2000

[54] METHOD OF PROTECTING METAL

[75] Inventors: Theodore R. Kozlowski; Frederick E. Noll, both of Horseheads; J. Mario Quintal, Campbell; Michael H. Wasilewski, Corning, all of N.Y.

[73] Assignee: Corning Incorporated, Corning, N.Y.

[21] Appl. No.: 09/050,770

[22] Filed: Mar. 30, 1998

Related U.S. Application Data

[63] Continuation-in-part of application No. 08/427,381, Apr. 24, 1995.

[51] Int. Cl.[7] ..... B05D 3/02

[52] U.S. Cl. ..... 427/374.7; 427/193; 427/376.2; 427/376.4; 427/399; 427/419.4

[58] Field of Search ..... 427/193, 374.7, 427/376.2, 376.4, 399, 419.4

[56] References Cited

U.S. PATENT DOCUMENTS

| | | | |
|---|---|---|---|
| 3,397,076 | 8/1968 | Little et al. | 117/70 |
| 3,704,333 | 11/1972 | Spangler et al. . | |
| 4,099,990 | 7/1978 | Brown et al. | 148/6.35 |
| 4,209,556 | 6/1980 | Brandeberry et al. | 427/330 |
| 4,444,732 | 4/1984 | Konoki et al. . | |
| 4,529,626 | 7/1985 | Baker et al. | 427/226 |
| 5,250,360 | 10/1993 | Andrus et al. | 428/471 |
| 5,298,332 | 3/1994 | Andrus et al. | 428/469 |

FOREIGN PATENT DOCUMENTS 2066696 7/1981 United Kingdom .

OTHER PUBLICATIONS

Barnes, J. et al., "Sulfur Effects on the Internal Carbuization of Fe–Ni–Cr Alloys," Oxidation of Metals, vol. 26, No. 5/6, p. 333–349, 1986.

*Primary Examiner*—Shrive Beck
*Assistant Examiner*—Michael Barr
*Attorney, Agent, or Firm*—Milton M. Peterson

[57] ABSTRACT

A method of protecting a metal against embrittlement when the metal is exposed to carbon or sulfur at an elevated temperature, the method comprising forming a thin, adherent, continuous coating of a glass on the surface of the metal prior to exposure to carbon or sulfur at an elevated temperature.

6 Claims, 3 Drawing Sheets

METHOD OF PROTECTING METAL

This application is a continuation-in-part of Ser. No. 08/427,381 filed Apr. 24, 1995 by T. R. Kozlowski, F. E. Noll, J. M. Quintal and M. H. Wasilewski under the title METHOD OF PROTECTING METAL and assigned to the same assignee as this application.

RELATED APPLICATION

U.S. application Ser. No. 08/979,089, a C-i-P of Ser. No. 08/427,338, filed Apr. 24, 1995, now U.S. Pat. No. 5,807,616, was filed Nov. 26, 1997 by D. M. Trotter under the title PREVENTING CARBON DEPOSITS ON METAL and assigned to the same assignee as the present application. It is directed to lessening the tendency for carbon to deposit on a metal surface when the surface is exposed, while heated, to a gaseous stream containing hydrocarbons. It is further directed to a thermal cracking process for olefin production and to furnace elements provided with a glass coating for use in a thermal cracking furnace.

FIELD OF THE INVENTION

A method of protecting a metal from embrittlement by carburization and/or sulfidation.

BACKGROUND OF THE INVENTION

It is well known that certain metals, particularly iron-based alloys, tend to become brittle when in contact with carbon at elevated temperatures. This condition is commonly referred to as carburization of the metal. A similar effect from exposure to sulfur has been noted and referred to as sulfidation.

The former is better known and recognized. However, the latter has recently been discussed by J. Barnes et al. in an article entitled "Sulfur Effects on the Internal Carburization of Fe—Ni—Cr Alloys" at pages 333–349 of Vol. 26, Nos. 5/6, 1986, *Oxidation of Metals*. The authors observed the formation of a surface layer of chromium sulfide which reduced internal carburization, but became a problem itself.

It is evident that carbon and sulfide can behave in similar manner in attacking certain alloys. The present invention arose from an effort to protect against carburization, and the invention is described with reference thereto. Nevertheless, it will be appreciated that protection against both carburization and sulfidation is needed, and that the invention provides protection against both.

The problem of metal protection, particularly the protection of stainless steels used in elevated-temperature environments, is common to many industrial applications. A typical example is carburization, with or without oxidation, in stainless steel, resistance-heating elements and various components and fixtures of heating furnaces. The simultaneous carburization and oxidation of stainless steel heating elements basically results from precipitation of chromium as chromium carbide. This is followed by oxidation of the carbide particles, and is common in nickel-chromium and nickel-chromium-iron alloys. As reported by Barnes et al., chromium sulfide also forms when sulfur is present.

Another typical industrial example involves the carburization of certain petrochemical-plant components, such as heater tubes. These tubes may be subjected to carburization, oxidation, or both. These two processes generate uneven volume changes, which result in very high internal stresses, together with metal loss. They also cause embrittlement due to carbon pickup and consequent carbide formation.

Ultimately, the carbide formation results in a loss of ductility that renders the component susceptible to brittle fracture. Heavy carburization also eliminates the possibility of repair welding. The present invention is described with particular reference to this application.

At the heart of a thermal cracking process is the pyrolysis furnace. This furnace comprises a fire box through which runs a serpentine array of tubing. This array is composed of lengths of tubing and fittings that may total several hundred meters in length. The array of tubing is heated to a carefully monitored temperature by the fire box.

A stream of feedstock is forced through the heated tubing under pressure and at a high velocity, and the product quenched as it exits. For olefin production, the feedstock is frequently diluted with steam. The mixture is passed through the tubing array which is commonly operated at a temperature of at least 750° C. During this passage, a carboniferous residue is fonned and deposits on the tube walls and fittings.

The carbon deposits initially in a fibrous form. It is thought this results from a catalytic action primarily due to nickel and iron in the tube alloy. The fibrous carbon appears to form a mat on the tube wall. This traps pyrolytic coke particles that form in the gas stream. The result is build-up of a dense coke deposit on the tube wall. This carbon build-up is commonly referred to as "coking".

A short range concern is the thermal insulation of the tube wall. This necessitates continually increasing the fire box temperature to maintain a steady temperature in the hydrocarbon stream passing through the furnace. Ultimately, the fire box and tube wall reach temperatures where operation must be discontinued and the carbon removed in a procedure referred to as decoking.

A longer range concern is the effect of the carbon on the metal tubes in the cracking furnace. During operation, a furnace is under considerable pressure. The furnace tube may also be subjected to a considerable tensile load. This may arise, for example, due to a $\Delta T$ across the tube wall during decoking, or during an automatic shutdown such as in an emergency.

During the life of a furnace, gradual embrittlement of the tube metal is observed with consequent loss of mechanical strength. Normally, pressure and tensile load remain relatively constant and not of concern. However, as a metal tube becomes weak due to embrittlement, these factors become significant. It then becomes necessary to shut the operation down and completely rebuild the furnace with new tubing.

Numerous solutions to the problems of coking and carburization have been proposed. One such solution involves producing the tubing from metal alloys having special compositions. Another proposed solution involves coating the interior wall of the tubing with a silicon containing coating such as silica, silicon carbide, or silicon nitride. Despite these numerous proposals, the problems still remain.

It would obviously be highly beneficial to be able to at least slow down the embrittlement process, and thus extend the life of the cracking furnace. It is a purpose of this invention to accomplish that desirable end. In a broader sense, a purpose is to provide a method of protecting metal alloys against embrittlement by contact with carbon or sulfur at elevated temperatures.

SUMMARY OF THE INVENTION

The invention resides in a method of protecting a metal alloy component of an article against metal embrittlement by carburization or sulfidation when the metal alloy component contains chromium and is exposed to carbon or sulfur at an elevated temperature, the method comprising providing a metal alloy component containing chromium, coating a surface of the metal alloy component with a dry, porous layer of a pulverized glass that is capable of combining with chromium oxide, heating the coated metal alloy component in an atmosphere containing oxygen to cause a layer of chromium oxide to form at the interface between the coating and the metal alloy component, thermally softening the glass coating and combining the layer of chromium oxide at the coating-metal alloy interface with at least a portion of the thermally softened glass adjacent thereto to form a vitreous layer that is tightly adherent to the metal alloy surface and that contains chromium oxide, and cooling the coated metal alloy component.

PRIOR ART

Prior literature of possible interest is listed in an accompanying document.

DESCRIPTION OF THE INVENTION

The invention employs a thin coating to act as an isolating layer for a metal that is subject to carburization and/or sulfidation. This isolating layer greatly minimizes carburization, thus keeping a metal ductile and extending its life, for example, as a furnace tube.

Figure 1:
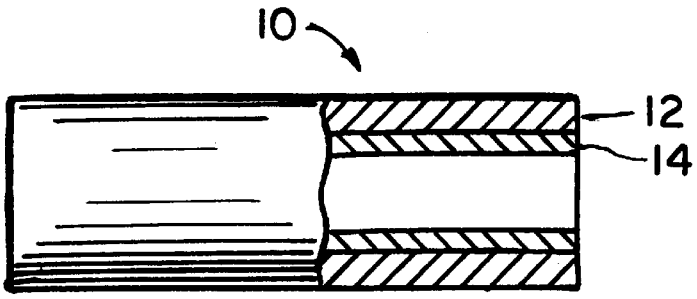
FIG. 1 is a front elevation view, partly broken away, showing a metal tube protected in accordance with the invention.

FIG. 1 is a front elevational view, partly broken away, of a segment 10 of a commercial reactor tube as used in a thermal cracking furnace. Such a commercial tube may be up to 12 meters (40 ft.) in length and have a diameter of 2.5–20 cm (1"–8"). Segment 10 comprises a cast alloy 12 having a coating 14 on its inner surface. It will be appreciated that a cracking furnace will comprise tubes and fittings, such as elbows, connecting adjacent lengths of tubing. It is contemplated that a complete cracking furnace, including tubes and fittings, will be coated in accordance with the invention. However, short lengths of tubing and fittings may be coated and joined, as by welding.

Accordingly, the invention is described with particular reference to iron-based alloys, such as austenitic-type alloys used in reactor tubes for thermal cracking furnaces. Such iron-based alloys have been observed to be particularly susceptible to carburization. However, carburization may occur in any thermal environment where a metal alloy is exposed to carbon. Accordingly, the invention is also applicable to such other processes as well.

The composition, as well as the physical properties, of the coating will depend on the particular application involved. For example, any element known to be poisonous, or otherwise detrimental, to a process should be avoided in the composition. Also, the coating must not soften, recrystallize, or otherwise undergo detrimental change at the maximum operating temperature, or in normal operating cycles.

The coating is first described in terms of a thermally crystallizable glass, that is a glass convertible by heating to a uniformly crystallized material known as a glass-ceramic. As explained later, such a glass is not a requirement. However, it is still a desirable coating material even when an intervening glass layer is ultimately formed.

As initially applied to the metal alloy, the coating is a flowable material composed essentially of a glass in particulate form. This coating is dried and heated to a temperature at or above the ceramming temperature for the glass. During this heating, and prior to complete ceramming, the glass must become sufficiently fluid so that it forms a continuous coating that wets the metal alloy surface. The ceramming temperature must be well below that at which the metal undergoes structural modification or other change.

Another consideration is a reasonable match in coefficient of thermal expansion (CTE) between the glass-ceramic and the metal which it coats. This becomes particularly important where austenitic-type metals are employed, since these metals tend to have high CTEs in the range of 130–180× $10^{-7}$/° C. with the higher CTE alloys having better properties. In such case, a relatively high silica content is desirable. This provides a cristobalite crystal phase, the inversion of which creates an effective CTE that provides an adequate expansion match.

The presence of alumina in the composition is beneficial to increase glass flow and surface wetting prior to crystallization of the frit. However, it may inhibit cristobalite formation as the frit crystallizes.

Where the feedstock is diluted with another material, the coating must be unaffected by the diluent. For example, hydrocarbon cracking is usually carried out in the presence of steam. In that case, the coating must not interact with the steam, either physically or chemically.

In summary, a glass-ceramic suited to present purposes should exhibit these characteristic features:

1. Have a composition free from elements detrimental to any given process.
2. Be capable of withstanding an operating temperature of at least 850° C. without undergoing appreciable physical or chemical change.
3. Have thermal expansion characteristics compatible with austenitic-type metals.
4. Have a ceramming temperature below a temperature at which the coated metal undergoes change.
5. Form an adherent, continuous coating.

Any glass-ceramic material that meets these several conditions may be employed. The alkaline earth metal borates and borosilicates, and alkaline earth metal silicates and aluminosilicates are particularly suitable. In general, alkali metal silicates and aluminosilicates are less suitable due to physical and/or chemical incompatibility. They tend to have low coefficients of thermal expansion, and alkali metals are incompatible with some processes. However, alkali metals are commonly present as impurities and may be tolerated as such.

Our preferred coating is a barium aluminosilicate or strontium aluminosilicate glass-ceramic. The barium aluminosilicate will have a primary crystal phase of sanbornite and minor phases of cristobalite and $BaAl_2SiO_5$ and will contain 20–65% BaO, 25–65% $SiO_2$ and up to 15% $Al_2O_3$. The strontium aluminosilicate will contain a primary crystal phase of $SrSiO_3$ and a minor phase of cristobalite and will contain 20–60% SrO, 30–70% $SiO_2$ and up to 15% $Al_2O_3$.

TABLE I sets forth, in weight percent on an oxide basis as calculated from the precursor glass batch, the compositions for several different glass-ceramics having properties that adapt them to use for present purposes. Examples 1–6 illustrate alkaline earth metal alumino borates or borosilicates. Examples 7–14 illustrate alkaline earth metal silicates which may contain minor amounts of alumina or zirconia.

TABLE I

| Ex. | $SiO_2$ | $B_2O_3$ | $Al_2O_3$ | BaO | MgO | CaO | ZnO | $ZrO_2$ | MnO | SrO | NiO |
|---|---|---|---|---|---|---|---|---|---|---|---|
| 1 | — | 19.1 | 27.9 | 42.0 | 11.0 | — | — | — | — | — | — |
| 2 | — | 25.4 | 18.6 | 56.0 | — | — | — | — | — | — | — |
| 3 | 17.5 | 20.2 | 29.7 | — | — | 32.6 | — | — | — | — | — |
| 4 | 9.6 | 22.2 | 32.5 | — | — | 35.8 | — | — | — | — | — |
| 5 | 30.6 | 12.7 | 3.8 | 15.9 | 23.5 | — | 13.5 | — | — | — | — |
| 6 | — | 27.0 | 19.8 | 29.7 | 7.8 | — | 15.8 | — | — | — | — |
| 7 | 32.0 | — | — | 40.9 | — | — | — | 8.2 | 18.9 | — | — |
| 8 | 33.9 | — | 2.9 | 43.3 | — | — | — | — | 20.0 | — | — |
| 9 | 33.2 | 4.8 | — | 42.4 | — | — | — | — | 19.6 | — | — |
| 10 | 65.0 | — | 6.9 | — | — | — | — | — | — | 28.1 | — |
| 11 | 47.2 | — | — | — | — | — | — | 12.1 | — | 40.7 | — |
| 12 | 54.1 | — | 5.7 | — | — | — | — | — | — | 23.3 | 16.8 |
| 13 | 38.3 | — | — | — | — | — | — | 5.9 | 22.7 | 33.1 | — |
| 14 | 62.7 | — | 5.3 | 32.0 | — | — | — | — | — | — | — |

Comparative tests were made on samples prepared as glass-ceramic coupons and as coatings on 5 cm (2") long coupons of an Fe—Cr—Ni alloy containing 0.45% carbon (HP-45 alloy). The metal pieces were cut from a pyrolysis furnace tube. The coatings had a thickness of at least about 0.0375 mm (1.5 mils). Thicker coatings may be employed, as described later, to facilitate the coating process and to provide a continuous coating.

Successful tests led to determining compatibility and effectiveness of glass-ceramic coatings with austenitic cast alloys of the type used in cracking furnace tubes. accordingly, tests were made on coupons which were cut from lengths of commercial tubing and were 5 cm (2") in length and 1.2–2.5 cm (½–1") wide.

Test samples were cut from coupons of three commercial Fe—Cr—Ni alloys: HP-40, HP-45 and HK-40. These alloys contain a minor amount of carbon, indicated in hundredths of a percent by the numeral in the designation, as well as certain other minor alloy constituents.

Two precursor glasses were used in forming the glass-ceramic coatings. One glass had the composition of Example 14; the other was composed of 53.5% $SiO_2$, 39.0% BaO and 6.5% $Al_2O_3$. A kilogram (2 pound) melt of each glass was made in a furnace operating at 1600° C. for four hours. Each melt was dri-gaged, that is, poured into water to quench the glass and cause it to fracture into particles. With subsequent larger melts, the molten glass was rolled to form a thin sheet which was then crushed.

To prepare a coating slurry, the broken glass was ball milled dry with alumina media for 8 hours in an alumina container. This reduced the glass to an 8 micron average particle size. Separately, a polybutyl methacrylate binder was mixed with equal parts of ethyl and amyl acetate to form a homogeneous vehicle.

The frit powder, in a ratio of 2.5 grams to 1 gram of binder, was added to the vehicle and rolled with zirconia balls in a plastic container to form a coating slip. It will be appreciated that the particular binder and vehicle are not critical, and the proportions would be adjusted for any given coating operation. The coating slip was applied to the inside wall of a tubing sample by repeatedly dipping the sample in the coating and drying to provide a coating having a thickness of about 200 mg coating/6.5 sq. cm (1 sq. in.).

The coated tube sample was then heated to cause the glass frit to soften and flow sufficiently to adhere to the metal. Further heating, at a somewhat lower temperature, cerammed the glass, that is, converted it by thermal crystallization to a glass-ceramic. This involved heating the coated samples to 500° C.; holding one hour; heating to 1150° C.; cooling to 1050° C. at furnace rate; holding 4 hours; and cooling to ambient. During this cycle the samples were supported by refractory supports.

Adherence of the coating was tested by making a saw cut in the glass-ceramic. This test is based on a finding that poorly adhering coatings quickly spall when touched by a saw. The coatings tested were considered to show good adherence.

Service life was tested by thermal cycling. In this test, the coated sample was held for 110 minutes at 850° C. It was then removed from the heating chamber for 10 minutes. During this time, it dropped to a temperature well below red heat. After 24 cycles, the samples were cooled and a portion of the coating removed by partial masking and grit blasting. Then, the partially coated samples were subjected to another 24 cycles. No spalling of the coating occurred on any of the samples tested even after partial coating removal.

The effect of particle size of the glass frit was determined by preparing slurries with mean particle sizes of 5.92, 8.25, 18.62 and 26.21 microns. These slurries were applied to test pieces of HP-45 metal tubes and subjected to a ceramming cycle. One set was heated to a top temperature of 1150° C.; a second set was heated to a top temperature of 1200° C.

The coatings prepared with the two larger size particles were inferior to the coatings produced with the smaller particle size material. Based on these tests, a coating material prepared with a glass frit having a mean particle size not over about 10 microns is preferred.

Tests conducted on coatings of varying thickness indicate that a fired glass-ceramic coating may have a thickness of 0.0375–0.250 mm (1.5–10 mils). For larger surfaces, such as large furnace tube interiors, a thickness of at least 0.075 mm is desirable to minimize the potential of pinholes and/or thin spots to form. With a thickness greater than 0.250 mm, there is a tendency to spall on heat cycling.

To test for carburization, coupons were partly coated with glass-ceramic. That is, a portion of a coupon was coated and the remainder left bare. The test samples were packed in carbon within a closed end Inconel sleeve. They occupied over half of the volume with the remainder packed with steel wool as a "getter" for oxygen. The open end was then closed and the assembly placed in a small electric furnace. The furnace was heated to 1100° C. and held at that temperature for 250 hours.

When the test samples were removed, it was observed that a heavy carbide coating had formed on the uncoated (exposed portion) of the test samples as well as on the Inconel sleeve. SEM photomicrographs revealed no evidence of carburization of the metal under the glass-ceramic coating. The exposed metal had carburized to a depth of about 400 microns.

A further test on correspondingly coated samples was then carried out employing the same test procedure, but at a test temperature of 850° C. and a test time of 500 hours. Again, SEM photomicrographs showed no carburization of the metal under the coating. The bare or exposed metal had carburized to a depth of about 40 microns.

A second test was conducted using the same test procedure and metal test pieces coated in the same manner. In this test, the temperature was maintained at a temperature of 1000° C. for 250 hours. As in the previous tests, the coated portions of the test pieces showed no evidence of carburization. The uncoated, exposed portions of the test pieces showed carburization to a depth of about 150 microns.

The applicability of the invention to metal alloys in general was demonstrated by conducting the test just described on a series of coupons of different metal alloys. These included 304 SS, Inconel, and 420 SS together with HP-45. Coupons of each alloy were coated with the glass-ceramics of both Example 12 and Example 14. Thus, seven tests were conducted, one sample having been lost in process.

After each test, no carburization could be measured under the coated portion of the coupon. Varying depths were measured on the bare or exposed portions of the coupons. These measured depths are shown in TABLE II in microns ($\mu$m).

TABLE II

| Alloy | Ex. 12 | Ex. 14 |
|---|---|---|
| 304 SS | 100 | — |
| HP-45 | 170 | 150 |
| Inconel | 50 | 50 |
| 420 SS | 120 | 80 |

It is evident that the glass-ceramic coating protected th, alloy against carburization in all cases. However, the greatest need for protection occurred with the HP-45 alloy.

Figure 2:
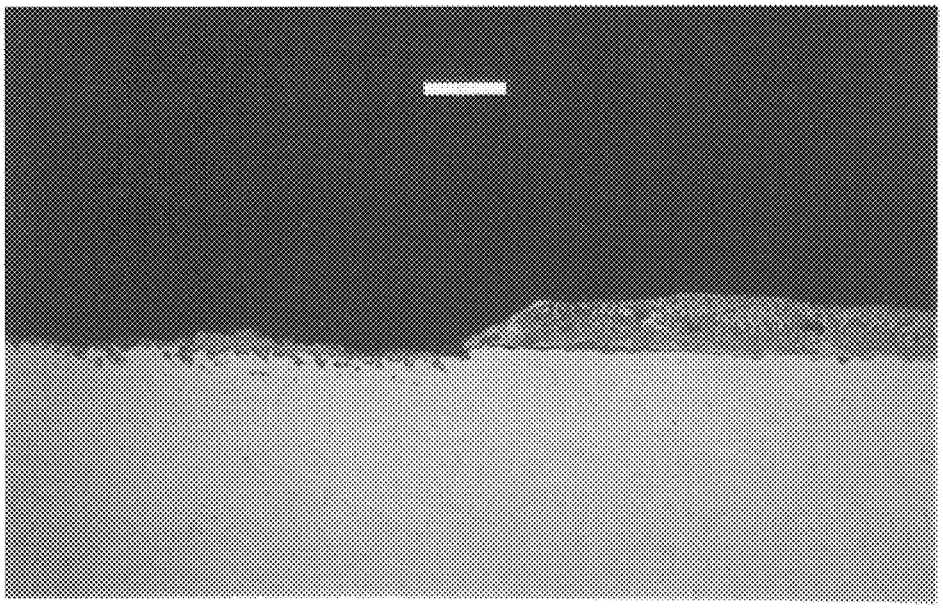
FIGS. 2 and 3 are photomicrographs showing in cross-section a metal test piece coated in accordance with the invention.
Figure 3:
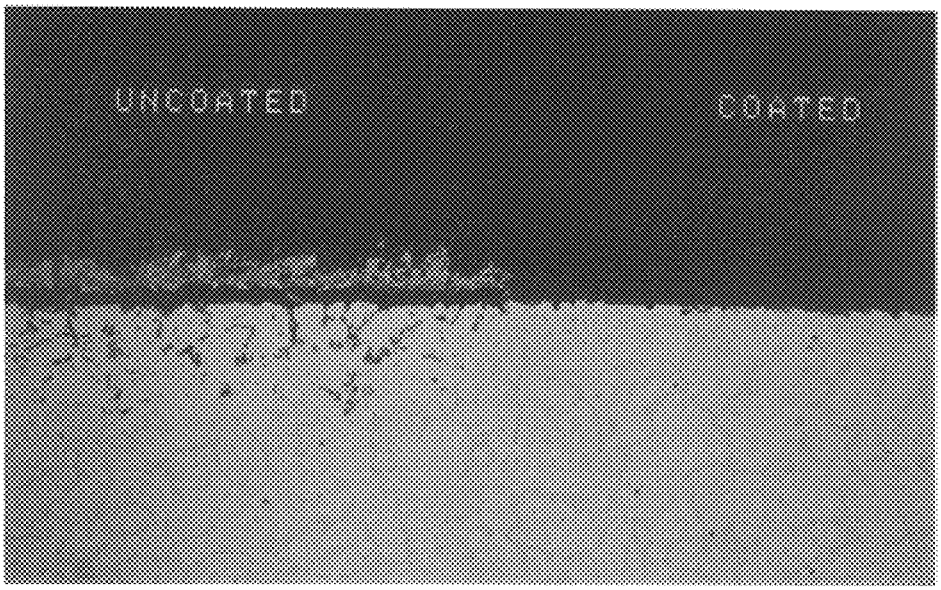

The effectiveness of the invention in minimizing carburization is further illustrated in FIGS. 2 and 3 of the accompanying drawings. These FIGURES are photomicrographs at a 100X magnification of cross sections of test pieces described above. FIGS. 2 and 3 show, respectively, a test piece treated for 500 hours at 850° C. and a test piece treated for 250 hours at 1000° C.

Each FIGURE shows a metal test piece, the lower portion of the picture being a cross section of the test piece. In each case, the right hand half of the metal surface was provided with a glass-ceramic coating. FIG. 2 shows the coating in place, whereas in FIG. 3 the coating was removed following the test.

Likewise, the left hand half of each FIGURE shows the condition of the exposed, that is uncoated, metal surface after the test. In each lecture, a typical carburized condition is observed. It was observed that a crust formed on the metal surface and that carbon penetrated along grain boundaries in the metal. Presumably, this resulted from chromium migrating from the grain boundaries to react with carbon as reported in the literature.

Experience has demonstrated that, when a metal alloy substrate containing chromium is coated and heated, a unique phenomenon occurs. When the coated metal alloy is examined, a thin layer of clear yellow glass is observed at the metal alloy-coating interface. Analysis indicates that the composition of this glass corresponds to that of the original pulverized glass with an addition of chromium oxide to the composition.

It is surmised that firing of the coated metal alloy causes chromium to migrate to the coating-metal alloy interface. There, porosity in the pulverized glass coating permits entry of oxygen which oxidizes the chromium to the oxide. As the glass softens to wet the metal alloy surface, that portion of the glass adjacent to the interface takes up the chromium oxide to produce a glass containing chromium oxide in its composition.

The glass, thus formed, unlike the original glass, resists crystallization. Rather, it forms a tightly adherent, glassy layer on the metal alloy surface intermediate the metal alloy and an outer layer of the original glass coating. This chromium oxide-containing glass forms a very thin layer, albeit highly effective.

It is normally convenient to apply a thicker coating of original glass and thus avoid thin spots. This leaves an outer layer that does not absorb chromium oxide, and hence is essentially chromium-free. Providing the original glass is thermally crystallizable, the thermal cycle can be held at an appropriate temperature to convert this outer layer to a glass-ceramic.

The invention is further described with attention to those conditions that are required, or desirable, in carrying out this version of the method. The glass employed will be melted, formed and pulverized in known manner as earlier described.

In this case, glass particle size is critical to the extent that a coating, when dry, must be of a porous nature. It must also sinter and soften to a continuous, glassy layer during the thermal processing. The coating must be sufficiently porous to permit ready access by oxygen to the coated metal surface for a reason to become apparent. The degree of porosity is not critical, but a porosity of about 60% by volume has been found to be quite satisfactory.

The glass, in particulate form, may be applied dry by any convenient application procedure. On large surfaces, such as the interior of cracking furnace tubes, it has been found convenient to apply a slurry produced by mixing the glass with a suitable vehicle. The slurry may then be applied to the interior surface of a tube by drawing a spray applicator through the length of the tube while the tube is being rotated. Alternatively, the spray applicator may be rotated while the tube remains at rest. When applied as a slurry, the coating must be dried to form a completely dry, porous coating on the metal surface.

Coating thickness is important as a practical matter when coating with a slurry, but otherwise is not critical. In theory, the coating need only be of sufficient thickness to form the continuous, chromium-containing, glassy layer on the metal surface. Such layer may be on the order of 5–10 microns thick. However, it may be difficult and expensive to produce such a thin coating that is continuous and uniformly thick on the inside of a large tube. Therefore, it has been found convenient, in coating cracking furnace tubes, to apply a layer of sufficient thickness to provide an ultimate fired coating ranging up to 0.250 mm. in thickness.

The metal body may be any high-temperature alloy having an appreciable content of chromium in its composition. The inventive method has been tested using iron-nickel-chromium alloys of the type commonly used in hydrocarbon-cracking furnaces. One such alloy, for example, is designated HK-45 indicating a carbon content of about 0.45%. This alloy is constituted, primarily, of about 37% iron, 35% nickel and 27% chromium. As explained later, a key ingredient in this alloy for present purposes, is the chromium. However, the chromium level need not be that high, an amount on the order of 10% or less being adequate to form an adherent glass layer in conjunction with the coating.

Any glass that softens at a sufficiently high temperature may be employed. The glasses previously described as convertible to glass-ceramics are particularly suitable.

Figure 4:
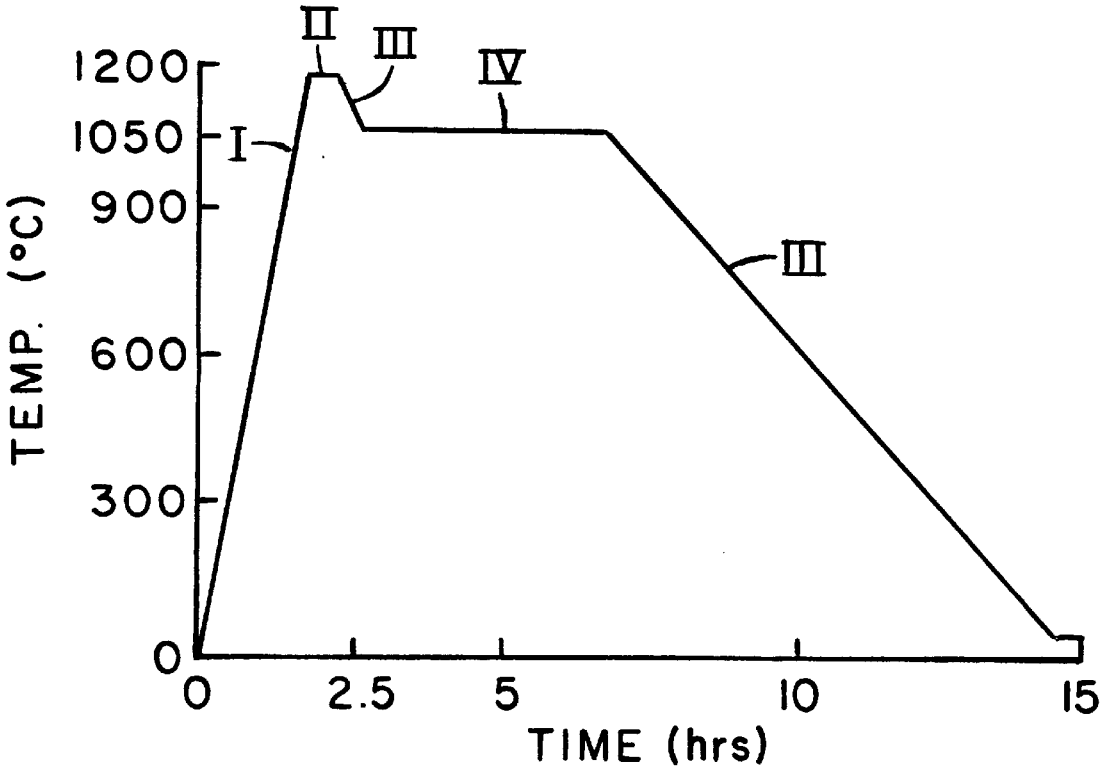
FIG. 4 is a graphical representation of a typical thermal cycle employed in carrying out the present invention.
Figure 5:
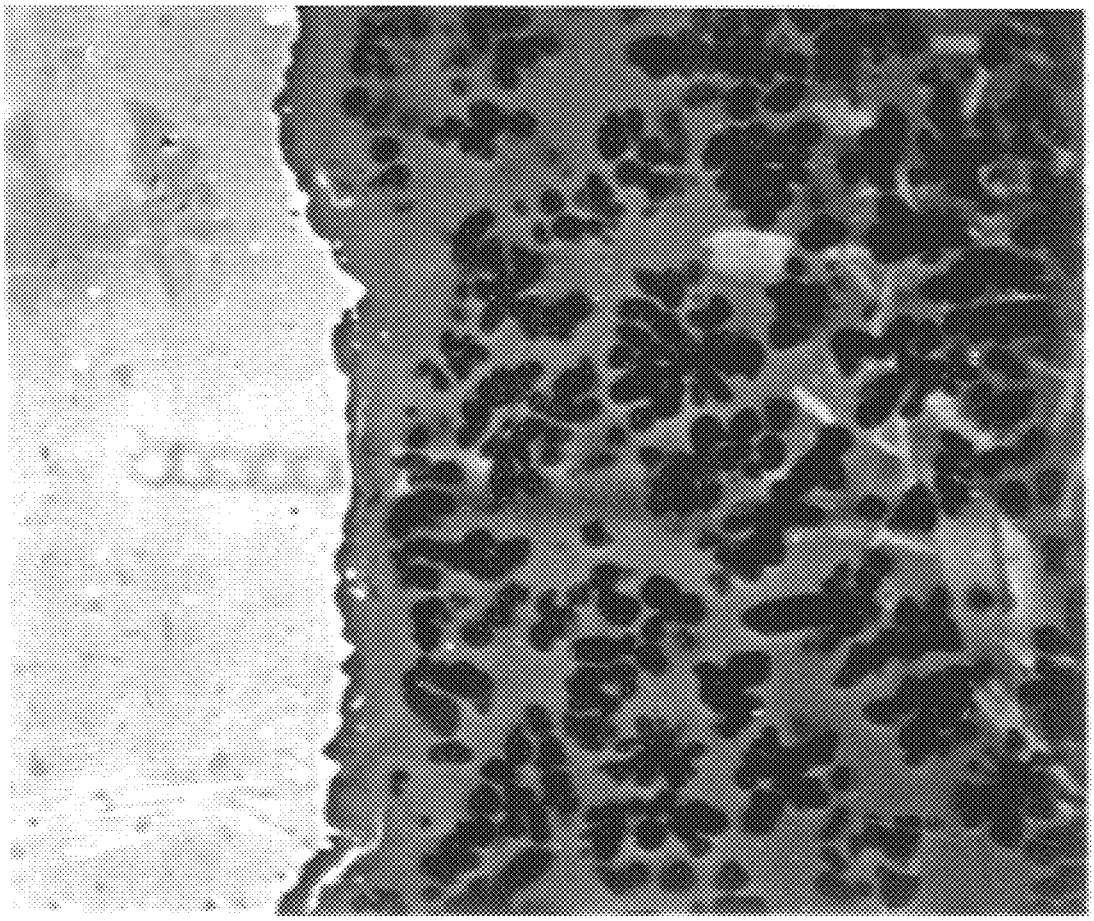
FIG. 5 is a photomicrograph showing in cross-section a metal tube segment coated in accordance with the invention.

The invention is further described with respect to the coating of a length of tubing for a test installation in a commercial furnace. FIGS. 4 and 5 depict the thermal cycle for firing the coating, and the fired product.

A glass having the composition of Example 14 in TABLE I was melted for use in preparing a coating material. The melt was quenched between rollers to produce a thin ribbon that was fragmented. The fragmented glass was ball milled dry with alumina media for eight hours in an alumina container.

A slurry was produced by mixing 3200 grams of the glass frit thus produced with 1600 ml. of distilled water, 64 grams of a polyvinyl alcohol binder, and 32 ml. of a surfactant. This mixture was rolled for an hour, and then allowed to age for 24 hours before being applied.

The slurry was applied to the inside surface of a tube seven feet in length for installation in a thermal cracking furnace for olefin production from hydrocarbons. The tube was composed of HK-45 alloy containing 27% chromium. The coating was applied to the interior wall of the tube by spraying while the tube was rotating. The coating was then dried to form a porous coating on the tube wall. The dried coating had a thickness equivalent to about 200 mg./6.5 sq. cm. (1 sq. in.), and an estimated porosity of about 60%.

The metal tube with its dry, porous coating of particulate glass was now subjected to a thermal treatment cycle. FIG. 4, in the accompanying drawing, depicts the thermal cycle for the glass of Example 14. Thermal cycles for other suitable glasses will vary in temperatures, but will follow the same general pattern. In FIG. 4, temperature is plotted in ° C. on the vertical axis, and time in hours is plotted on the horizontal axis.

In stage I, the coated metal is heated in air, while chromium from the metal collects at the coating-metal interface, and is oxidized to chromium oxide. During stage II, the porous glass coating softens and forms a continuous, non-porous, vitreous coating on the metal. In the course of this stage II heating step, the chromium oxide is dissolved in the glass adjacent to the metal surface as the glass softens. The chromium-containing glass forms a thin glass layer on the metal surface that is tenaciously adherent to that surface.

It is evident that the initial coating of particulate glass must be sufficiently porous to permit ready access of oxygen to react with the chromium. Also, the porous nature of the coating must be retained until the chromium migrates to the surface and oxidizes. Hence, the coated tube must be brought up to temperature gradually, a time of about two hours usually sufficing. Once at the top temperature, the coated metal is held for a sufficient time (stage II) to dissolve the chromium oxide and fully wet the metal surface. A time of about thirty minutes has been found sufficient in the coating of furnace tubes.

At this point in the cycle, the coated, metal surface may be cooled to ambient temperature (stage III) at furnace rate. It is also apparent that the porous, glass coating, as initially applied, need only be of sufficient thickness (10 microns) to form the softened layer that absorbs the chromium oxide. However, it has been found advantageous, in coating tubes for installation in a petrochemical cracking furnace, to apply a thicker coating.

FIG. 5 is a photomicrograph showing a cross-section of a metal tube segment having a relatively thick coating. The photo was taken after a complete thermal cycle. The clear portion at the left of the photo is the metal tube. The relatively thick layer on the right is a portion of the glass that has not absorbed chromium oxide. Intermediate is the thin layer of glass containing absorbed chromium oxide and usually being 5–10 microns thick.

In FIG. 5, the thick portion of the coating on the right has been converted from the glassy state to a glass-ceramic state. This is accomplished by stopping the cooling part of the cycle at the glass crystallization temperature. The coated metal is held at that temperature for a sufficient time to effect crystallization of the glass, thereby changing it to the glass-ceramic state. In FIG. 4, this is indicated as stage IV by a horizontal segment in the cycle curve as about 4 hours at about 1050° C.

It will be observed that the glass layer containing chromium oxide does not crystallize, but rather remains glassy. The presence of chromium oxide in the glass inhibits crystallization.

The thicker coating illustrated in FIG. 5 has advantages and disadvantages. It permits greater flexibility in coating, a less expensive application step, and a longer coating life under erosive conditions. However, it does introduce a glass-ceramic layer of different thermal coefficient of expansion from the class. Also, the thicker coating may have an insulating effect that impedes heat transfer into the gas stream being processed.

Two lengths of tubing, for installation in a hydrocarbon cracking furnace, were produced from the same alloy under essentially the same conditions. The purpose was to compare coated and uncoated tubes under the same operating conditions. One tubing length was installed as received, that is, with no coating. The second tubing length was coated on its interior surface with a glass-ceramic precursor glass having the composition shown as Example 14 in TABLE I.

The glass was melted, cooled and pulverized as described earlier. The glass powder was mixed with a vehicle to form a slurry. The slurry was spray coated on the interior surface of one tubing length to a depth of about 0.070 mm. The coated tube was dried and fired to form an adherent glass-ceramic coating on the tube surface.

Both tubes were installed in a hydrocarbon cracking furnace where they were operated under essentially identical conditions for a few days short of a year. Initially, the feedstock was an ethane-rich natural gas stream. This was then switched to a naphtha liquid feedstock until shutdown.

When the furnace was shut down, the tubes were removed and sections cut out for analysis. This analysis was an electron probe microanalysis (EPMA) employing an electron microprobe instrument (JFOL Model No. 8900 R). The alloy analysis of the tubes, as originally produced, was essentially identical.

Analytical measurements were made on polished samples to depths of 0.35 mm (350 microns) from the interior tube surface including any residual coating. The analytical results on the coated test piece were erratic to a depth of about ten microns, and then remained relatively constant.

The uncoated test piece provided a considerable degree of variation. The results, as shown later, were quite erratic over the initial 0.020–0.025 mm from the tube surface. Again, at depths between about 0.070 and 0.130 mm, Si and C predominated. This appeared to be due to silicon carbide formation, indicative of carburization occurring. This did not appear in the coated test piece.

Otherwise, expected component levels were constant, except for the chromium level. This was depressed from its normal content of about 21% to a content of about 14% at about 0.025 mm. At increasing depths, the chromium content gradually increased back to its normal 21% content at a depth of 0.250 mm.

The analyzed contents of four key alloy constituents, in the initial erratic surface layer on each test piece, are shown in TABLE III, below.

TABLE III

| | Coated | | | | Uncoated | | | |
|---|---|---|---|---|---|---|---|---|
| Depth (mm) | Ni | C | Cr | Si | Ni | C | Cr | Si |
| 0.001 | 0 | 20 | 33 | 4 | 0 | 4 | 62 | 0 |
| 0.002 | 0 | 16 | 26 | 7 | 0 | 4 | 60 | 2 |
| 0.003 | 0 | 17 | 23 | 11 | 0 | 5 | 53 | 3 |
| 0.004 | 0 | 14 | 17 | 12 | 0 | 6 | 47 | 10 |
| 0.005 | 0 | 5 | 22 | 13 | 0 | 7 | 53 | 17 |
| 0.006 | 3 | 16 | 13 | 13 | 0 | 9 | 57 | 18 |
| 0.007 | 15 | 20 | 10 | 10 | 0 | 10 | 54 | 28 |
| 0.008 | 34 | 38 | 13 | 9 | 0 | 12 | 42 | 32 |
| 0.009 | 38 | 8 | 11 | 4 | 0 | 14 | 34 | 29 |
| 0.010 | 39 | 6 | 21 | 3 | 0 | 7 | 50 | 2 |
| 0.011 | 38 | 7 | 21 | 3 | 0 | 4 | 24 | 2 |
| 0.012 | 38 | 7 | 21 | 3 | 0 | 4 | 15 | 2 |
| 0.013 | 38 | 7 | 21 | 3 | 3 | 6 | 23 | 2 |
| 0.014 | 36 | 7 | 21 | 3 | 33 | 7 | 37 | 2 |
| 0.015 | 36 | 7 | 21 | 3 | 40 | 6 | 58 | 2 |
| 0.016 | 37 | 7 | 21 | 3 | 38 | 6 | 60 | 2 |
| 0.017 | 37 | 7 | 21 | 3 | 38 | 8 | 62 | 2 |
| 0.018 | 37 | 7 | 21 | 3 | 39 | 8 | 61 | 2 |
| 0.019 | 38 | 8 | 21 | 3 | 40 | 7 | 26 | 2 |
| 0.020 | 39 | 8 | 21 | 3 | 40 | 7 | 14 | 2 |

The analytical process employs carbon in a manner that imparts a reading, of about 7%. Therefore, the carbon values may be diminished by that amount. The carbon and silicon contents remained essentially constant at about 7% and 2% respectively at depths greater than those recorded in TABLE III. The exception occurs in the 70–130 micron area on the uncoated test piece as noted earlier.

It is apparent that both the coated and uncoated tubes underwent a dramatic change in a small surface zone. This zone was about 0.010 mm in the coated tube, and about 0.020 mm in the uncoated tube. However, below about 0.010 mm depth, the proportional elemental contents in the alloy of the coated tube remained essentially constant.

In addition to the greater degree of surface chance both in depth and degree, the uncoated tube underwent a marked change at greater depths as well. The formation of a silicon carbide zone has been noted. The most notable change occurred in the chromium content. This element migrated from a depth of about 0.250 mm in the uncoated tube as compared to about 0.010 mm in the coated tube.

These analytical measurements, made on comparative tubes actually exposed to furnace operating conditions, rather conclusively demonstrate the protection offered by the present inventive coating against composition and structural change in the furnace tube alloy. It is these changes that are generally thought to contribute significantly to metal alloy embrittlement.

The invention has been largely described with respect to components in a thermal cracking furnace for hydrocarbons, an application of major significance. However, its broader application to metal components exposed to embrittling conditions will be readily apparent.

We claim:

1. In an article having a metal alloy component containing chromium, a method of protecting the metal alloy component against metal embrittlement by carburization or sulfidation when the metal alloy component is exposed to carbon or sulfur at an elevated temperature, the method comprising providing a metal alloy component containing chromium, coating a surface of the metal alloy component with a dry, porous layer of a pulverized glass that is thermally crystallizable and that is capable of combining with chromium oxide, heating the coated metal alloy component in an atmosphere containing oxygen to cause a layer of chromium oxide to form at the interface between the coating and the metal alloy component, thermally softening the glass coating and combining the layer of chromium oxide at the coating-metal alloy interface with an inner portion of the thermally softoned glass adjacent thereto to form a vitreous layer that is tightly adherent to the metal alloy surface, that contains chromium oxide, and that resists crystallization, the outer portion of the thermally softened glass remaining essentially uncombined, and cooling the coated metal alloy component to a lower temperature at which the outer portion of the glass layer that is essentially chromium-free crystallizes, holding at that temperature for a sufficient time to crystallize the glass, and then cooling the metal alloy component with a bi-layer coating of glass and glass-ceramic.

2. A method in accordance with claim 1 which further comprises producing a glass that is thermally crystallizable and that is capable of combining with chromium oxide, pulverizing the glass, mixing the pulverized glass with a vehicle to form a slurry, applying the slurry to the surface of the metal component to be coated, and drying the coating to a porous layer through which oxygen is accessible to the metal alloy surface.

3. A method in accordance with claim 2 in which the glass to be pulverized has a composition selected from a group of glass families consisting of alkaline earth metal silicates, aluminoborosilicates and aluminoborates.

4. A method in accordance with claim 2 in which the step of forming the pulverized glass layer on the metal alloy component surface comprises applying the coating in such amount that, when dry, the coating has a thickness of at least 10 microns, but not over about 0.25 mm.

5. A method in accordance with claim 1 which comprises heating the coated metal alloy component to a temperature of about 1200° C. to form the chromium oxide-containing glass and adhere it to the metal alloy surface, cooling the coated metal alloy component to about 1050° C. and holding at that temperature for about 4 hours to crystallize the chromium free glass layer and then cooling the metal alloy component with the bi-layer coating.

6. A method of protecting a metal alloy element of a thermal cracking furnace from embrittlement due to exposure of the element to carbon particles during operation of the furnace, the method comprising providing an iron-nickel-chromium alloy furnace element, coating a surface of the furnace element with a dry, porous layer of a pulverized, barium aluminosilicate, thermally crystallizable glass that is capable of combining with chromium oxide, heating the coated furnace element in the presence of oxygen. to a temperature of about 1200° C. in an oxygen-containing atmosphere while chromium migrates to the furnace element surface to form an oxidized layer of chromium at the interface between the coating and the metal alloy, continuing to supply heat to thermally soften the pulverized glass layer and to cause at least a portion of the layer adjacent to the interface to form a vitreous layer that contains chromium oxide and that forms a continuous adherent layer on the metal alloy surface, and cooling the coated metal alloy furnace element, to about 1050° C., holding at that temperature to crystallize that portion of the pulverized glass coating that is chromium-free, and cooling the furnace element to ambient, whereby the metal alloy furnace element is isolated from contact with the carbon particles.

* * * * *